United States Patent [19]

Walpin et al.

[11] Patent Number: 4,853,993

[45] Date of Patent: Aug. 8, 1989

[54] ADJUSTABLE BODY POSITIONER

[75] Inventors: Arline Walpin; Lionel A. Walpin, both of Los Angeles, Calif.

[73] Assignee: Roloke Company, Culver City, Calif.

[21] Appl. No.: 180,095

[22] Filed: Apr. 11, 1988

[51] Int. Cl.[4] ..... A47C 20/04

[52] U.S. Cl. ..... 5/431; 5/481; 5/465; 5/433

[58] Field of Search ..... 5/431, 481, 465, 433, 5/437, 432

[56] References Cited

U.S. PATENT DOCUMENTS

| | | | |
|---|---|---|---|
| 2,777,138 | 1/1957 | Gallagher | 5/433 |
| 3,243,828 | 4/1966 | McCarty | 5/437 |
| 3,258,791 | 7/1966 | Kaplan | 5/481 |
| 3,333,286 | 8/1967 | Biolik | 5/431 |
| 3,736,023 | 5/1973 | Lyons | 5/465 |
| 3,952,346 | 4/1976 | Carlson | 5/433 |
| 4,207,635 | 6/1980 | Leroy | 5/437 |
| 4,393,530 | 7/1983 | Stark | 5/437 |
| 4,528,706 | 7/1985 | Branker | 5/431 |
| 4,686,725 | 8/1987 | Mitchell | 5/481 |
| 4,752,982 | 6/1988 | Jones et al. | 5/433 |

FOREIGN PATENT DOCUMENTS

| | | | |
|---|---|---|---|
| 546541 | 4/1956 | Belgium | 5/465 |
| 398246 | 9/1933 | United Kingdom | 5/433 |

*Primary Examiner*—Alexander Grosz
*Assistant Examiner*—Eric K. Nicholson
*Attorney, Agent, or Firm*—Lyon & Lyon

[57] ABSTRACT

A versatile, multi-angle body positioner having a contoured surface corresponding to the general shape of the human torso, including the shoulder girdles, and which also can be made to support the arms. This is accomplished with a foundation which is comprised of a hinge means, a top substructure and a bottom substructure. The positioner is made multi-angled through the inclusion of a replaceable insert interleaved between the top substructure and the bottom substructure.

3 Claims, 2 Drawing Sheets

ADJUSTABLE BODY POSITIONER

BACKGROUND

1. Field of the Invention

The field of the invention is body positioners; more specifically, portable adjustable body positioner cushions.

2. The Prior Art

When a person is bedridden or mostly confined to a bed, either in a hospital or at home, for long periods of time, it is medically important tha the person be able to change his or her reclining angle and oft times to come to a sitting position without leaving the confines of the bed. If the person is fortunate to be bedridden in one of the larger more modern hospitals, it will generally have motorized or hand adjustable beds that allow tha patient to elevate the upper torso to various desired angles. Unfortunately, not all hospitals have these beds and even if they do, not all patients can afford the expense. Upon discharge from the hospital having motorized or hand adjustable beds many patients are still required to spend long periods of time restricted to a bed. Sometimes permanently. In these cases the majority of people can not afford (and often there are no provisions in their insurance for) the purchase of one of these adjustable beds. In these situations bedridden people must rely upon propping themselves up by stuffing conventional pillows behind their backs or purchasing conventional wedge-shaped cushions.

The use of conventional pillows stuffed behind the back to change the reclining position or the seating position is not satisfactory. Conventional pillows used in this manner do not have either the form or the resilience to provide the necessary postural support that is required to prevent undue physical stress to muscles, joints and connective tissues resulting in short term discomfort and microtrauma. When conventional pillows are used in this manner for extended periods of time, long term damage to those structures may even result. Use of conventional pillows for this purpose may also result in prolonged excessive pressures in small areas. In other words, the use of the conventional pillow stuffed behind the back generally fails to evenly distribute the body weight over the entire skin surface resting on the pillow. Instead, depending on how the conventional pillow is stuffed, the entire weight of the upper torso will be supported in a small area creating unusually high pressures on the skin in that one spot. Furthermore, the use of a conventional pillow stuffed behind the back cannot guarantee adequate air flow to the skin surface contacting the pillow. Because of the prolonged static pressures concentrated in small areas and the lack of air flow, extended use of conventional pillows stuffed behind ones back interferes with tissue (skin) nutrition, dramatically increasing the potential for bed sores and other skin problems. When using conventional pillows in this manner, there is also no mechanism which provides alternating external pressure to the skin in contact with the pillow. The provision of such alternating external pressure would improve blood circulation to the skin by intermittently reducing the external pressure on the skin to below that of skin capillary pressure actually facilitating better skin nutrition.

The use of conventional wedge-shaped cushions, while an improvement over the use of conventional pillows, is still not a complete solution. These conventional wedge-shaped cushions are only usable in two fixed positions. Viewed in cross-section, the prior art cushions typically are right triangles. Placing the short leg of the triangle on the bed, provides the user with a single seated position. Placing the long leg of the triangle on the bed, provides the user with a single slightly elevated reclined position. The problems with these prior art cushions generally begin when the person largely restricted to bed wants (or needs) to sit at a different angle or change the angle of the reclined position a little. The solution to date of course has been for the user to stuff a conventional pillow between himself-/herself and the cushion, or behind the cushion and the bed. If the former solution is employed all of the problems inherent with the use of a conventional pillow come into play. If the latter solution is adopted, the conventional cushion becomes unstable and fails to provide the necessary support, or worse yet, forces the upper torso into an alignment that is detrimental to the joints, muscles and connective tissues of the back, neck or hips.

Thus, the prior art does not include an inexpensive way to provide multiple angles for sitting and reclining while still providing the proper support for controlled alignment and movement of the upper torso. Nor do the prior art solutions provide a mechanism for enhancing natural skin nutrition (aeration and capillary blood flow) during use.

SUMMARY OF THE INVENTION

The present invention is a versatile, multi-angle body positioner which has a contoured surface corresponding to the general shape of the human torso, including the shoulder girdles, and which also can be made to support the arms. This is accomplished with a foundation which is comprised of a hinge means, a top substructure and a bottom substructure. The uppermost surface of the foundation has a concave widthwise contour which cradles and supports the upper torso. The top and bottom substructure intersect at the hinge means. The present invention is multi-angled including a replaceable insert interleaved between the top substructure and the bottom substructure.

The top substructure comprises an uppermost surface having a convoluted texture to allow the users back to gain the benefits of alternating external skin pressures and air circulation. The alternating external pressure on the skin periodically reduces the skin pressure below the blood pressure in the capillaries near the skin surface providing better circulation of the blood in the skin. The air circulation allows the natural phenomena of perspiration to maintain the skin at its normal temperature. This decreases the change of excessive perspiration which, in combination with increased skin temperature and a lack of air circulation caused by constant steady external pressure, often results in skin maceration. The net result is improved skin nutrition and avoidance of pressure sores which are physiologically disruptive, a source of compounding diseases and extremely costly to treat.

The inclusion of the removable interleaved insert allows the height and angle of tilt of the overall body positioner to be varied for the reclined user and allows the depth and angle of inclination of the overall invention to be varied for the seated user.

The overall shape of the surface on which the part of the body above the waist rests is concave from side to side to accommodate and to support both the thoracic spine's kyphosis and the natural convex shape of the chest. Arm support pieces are included to further shape the contour to cradle the upper torso. This overall shape provides for a gently sloped, comfortable and protective support surface for the body to rest upon in semi-reclined and seated positions.

The unique overall design of the present invention provides support which allows the user to rest more comfortably in bed by allowing the muscles to relax, while relieving the spine from weightbearing stresses. This can be very beneficial to people with neck, thoracic, low back and shoulder girdle pain. In addition to providing support, the widthwise concave contour provides a certain degree of safety to persons who are restricted to a bed by supporting the trunk when the person shifts the body's center of gravity by, for example, reaching or rolling from side to side. The unique contour protects the user against falling out of bed or suffering sprains/strains of ligaments/muscles when compensating for loss of body balance as a resulf of a sudden shift in the body's center of gravity.

The present invention can be very helpful to the person with forward bent posture of the upper torso which often results from wedge shaped compression fractures of the thoracic spine due to osteoporosis. In this condition the location of the upper body's center of gravity (concentration of body weight from the thoracic-lumbar junction to the top of the head) is shifted forward from its normal position to a point well anterior to the spine. This results in an unnatural constant slump. When such a person is seated, the forwardly shifted concentration of upper body weight pulls the person further forward and downward into an even greater slump. Use of the present invention can provide some relief and comfort when such a person is in the seated or reclined positions. The additional comfort is achieved because when such a person leans backward into a properly adjusted boy positioner of the present invention, the upper body's center of gravity is actually repositioned so that it is posterior to the spine. Such a shift generally eliminates the upper torso weight as a cause of further postural slumping (thoracid hyperkyphosis) and anterior vertebral wedge compressions. Without the present invention's adjustability of the angle from vertical to fit such a person's potentially changing particular needs when that person is in the seated position the postural problem—both functional and structural—can worsen.

Also, when an osteoporotic person with wedge-shaped vertebral compression fractures is in the seated position, that person's head will have a tendency to roll forward and downward while the pelvis rolls backward. This can cause full spinal convexity along the entire back of the spine and increased anterior torques. This increases the downward force on the front of the spine resulting in increased vertebral wedging. The use of the present invention properly adjusted in either the semi-reclined or seated position promotes a lean back body position, shifting all the weight above the pelvis posteriorly, past the vertical, generally alleviating some of the damaging forces from the spine.

Additional categories of users who may benefit from use of the present invention are persons with:

(a) Congestive heart failure (even mild). The invention can be adjusted to elevate the head and torso to a position that allows for the easiest breathing.

(b) Mechanical breathing disorders as with weak or high positioned thoracic diaphragm muscles.

(c) Hiatus hernia with reflux of gastric contents back up into the esophagus. The adjustability allows the elevation to vary, providing an additional measure of benefit as the user's clinical condition improves or worsens.

(d) Painful dysfunctions of the spine. The spine is a multi articulated (multi-segmented) system of levers consisting of joints, muscles, connective tissue (fascia), ligaments and joint capsules at every segment of the spine from the upper neck to the lower back. The normal spine is mobile at every level. The spinal joints and related components need to adapt to spinal pain and abnormal areas of spinal motion. Thus, the need for adjustability in the seated positions and semi-reclined positions is obvious. Of course the need will vary as the conditions improve or deteriorate. For example, if one portion of the spine is painful and has restricted motion the spine must be positioned to adapt elsewhere. That is why the ability to adjust the angle of elevation is important.

Patients with muscles spasm or joint irritation, i.e., somatic dysfunctions, or patients with soft tissue contractures or intervertebral joint derangements, benefit from varying the sitting and reclining angles as their clinical situation changes, i.e., as the flexibility and pain at specific joints and soft tissue vary.

Accordingly, it is an object of the present invention to provide a relatively inexpensive body positioner which offers versatility because the height and angle of tilt are adjustable in both the seated and semi-reclined positions while still providing beneficial support and comfort to the torso, upper extremities, neck and head in semi reclined positions and similar beneficial support and comfort to the torso, upper extremities and neck in seated positions. Other and further objects and advantages are included herein and others would be obvious to those skilled in the art from the description and explanation of the invention set forth herein.

DETAILED DESCRIPTION OF THE DRAWINGS

Figure 1:
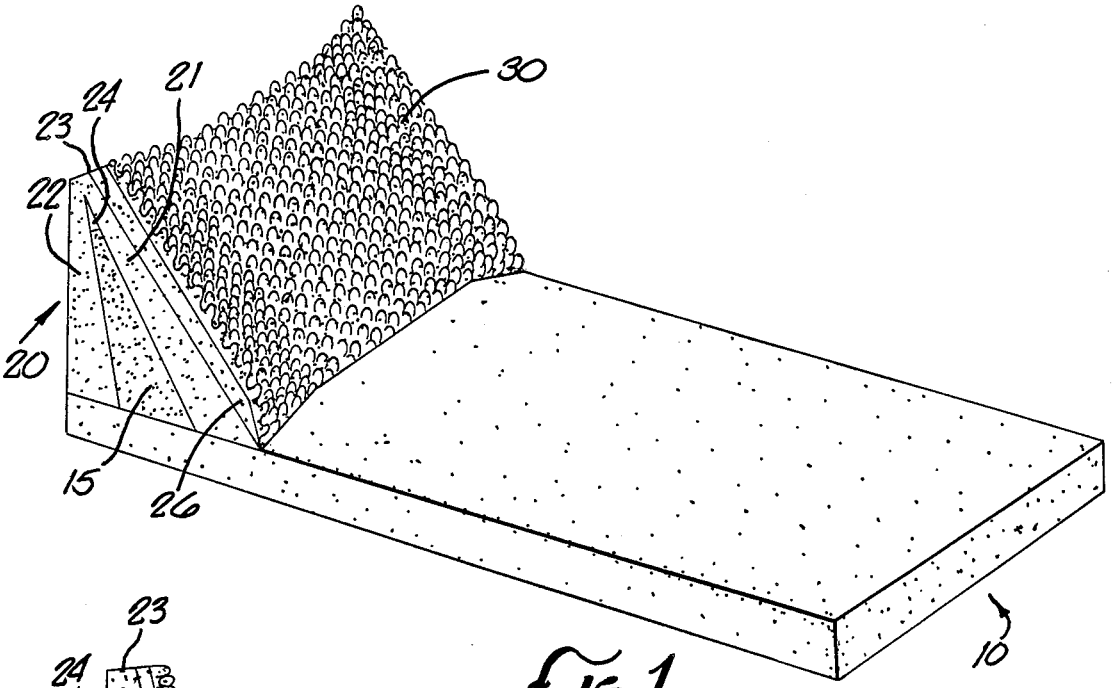
FIG. 1 is a perspective view of the preferred embodiment of the present invention as it would be utilized in the seated position.
Figure 2:
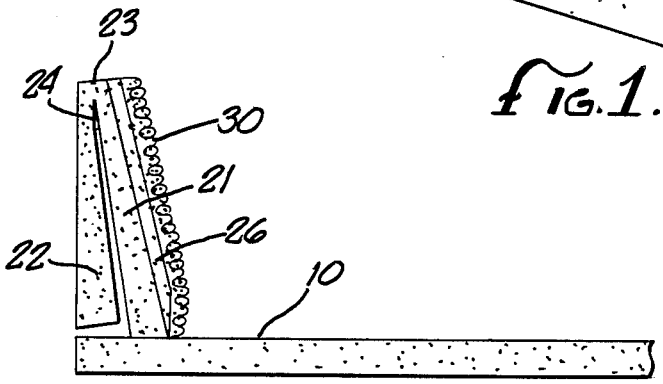
FIG. 2 is an end view of the preferred embodiment of the present invention as it would be utilized in the seated position with the insert removed.
Figure 3:
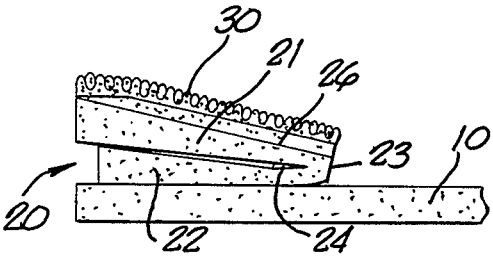
FIG. 3 is an end view of the preferred embodiment of the present invention as it would be utilized in the semi-reclined position with the insert removed.
Figure 4:
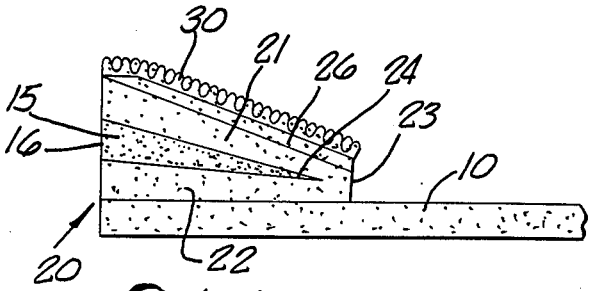
FIG. 4 is an end view of the preferred embodiment of the present invention as it would be utilized in the semi-reclined position.
Figure 5:
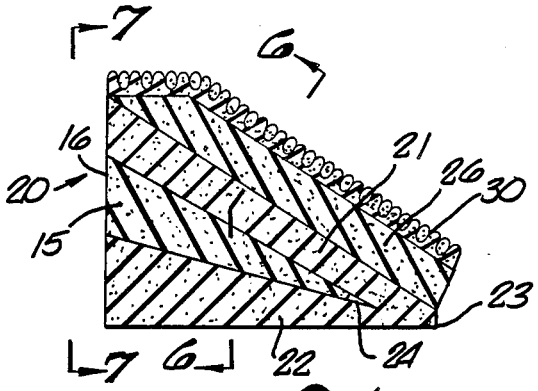
FIG. 5 is a cross section of the preferred embodiment of the present invention taken alone plane 5—5 of FIG. 7.
Figure 6:
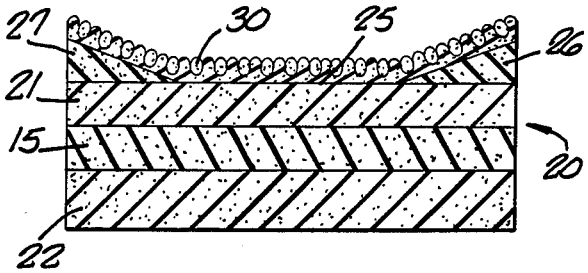
FIG. 6 is a cross section of the preferred embodiment of the present invention taken alone plane 6—6 of FIG. 5.
Figure 7:
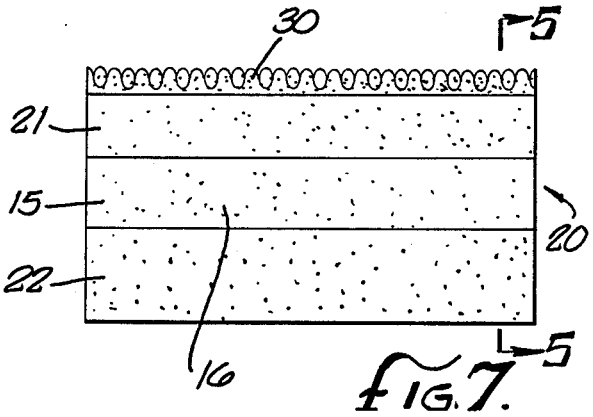
FIG. 7 is a cross section of the preferred embodiment of the present invention taken along plane 7—7 of FIG. 5.

The preferred embodiment of the present invention is shown in FIGS. 1 and 2 as it would be utilized in a seated position on a bed 10. The same embodiment is shown as it would be utilized in the semi-reclined position in FIGS. 3 and 4. Through removal of the interleaveable insert 15 the angle from vertical and horizontal of the upper surface 25 of the present invention is adjusted as shown in FIGS. 2 and 3.

In the preferred embodiment, the present invention is comprised of a foundation 20 which is comprised of a top and bottom substrate 21 and 22. The foundation 20 includes an acute angle edge 23 and a concave widthwise contour.

The top and bottom substructures 21 and 22 are joined at the acute angle edge 23 by a hinge means. In the preferred embodiment the hinge means is accomplished by forming the top and bottom pieces 21 and 22 from a single piece of foam and leaving them attached at the apex 24, which is the line at the intersection of the top and bottom pieces 21 and 22. In the preferred embodiment the bottom substructure 22 is approximately 1.5 inches, preferably about 1.25 inches, thick at the apex 24 and the top substructure 21 is approximately 2 inches, preferably 1.75 inches, thick at the apex 24. Preferably the hinge means is approximately 4 inches in lenth from the apex 24 to the acute angle edge 23.

The insert 15 is formed to allow it to be replaceably interleaved between the top and bottom substructures 21 and 22. In the preferred embodiment the insert 15 is triangular in cross section, as are the top and bottom pieces 21 and 22. The insert 15 may have a base 16 of any thickness, but it has been found to be most advantageous to have the base 16 approximately 5 inches thick.

To obtain the concave widthwise contour of the upper surface 25 of the top structure 21, arm support pieces 26 and 27 are employed. The arm support pieces 26 and 27 are attached substantially perpendicular to the acute angle edge 23 at the sides of the top substructure 21. The arm support pieces 26 and 27 are preferably substantially triangular in cross section and truncated at the end opposite the acute angle edge 23. In the preferred embodiment the arm support pieces 26 an 27 are constructed from a foam material.

The uppermost surface 25 of the top substructure 21 has a convoluted texture. In the preferred embodiment this texture is achieved by attaching a nodulated foam pad 30 to the entire surface 25 including over the arm support pieces 26 and 27.

Thus, the present invention has been described. While embodiments, applications and advantages of the invention have been shown and described, as would be apparent to ones skilled in the art, many more embodiments, applications and advantages are possible without deviating from the inventive concepts described herein. The invention, therefore, is not to be restricted except in accordance with the spirit of the appended claims.

We claim:

1. An adjustable body positioner comprising a foundation and an insert, said foundation being of a one piece construction and manufactured from a foam material and comprising an edge, a top piece and a bottom piece; said top and bottom pieces and said insert having substantially triangular cross sections and said insert being removeably interleaved between said top and said bottom piece, said top piece and said bottom piece are hinged along said edge of said foundation; said foundation further comprising an uppermost surface, a concave contour along the dimension parallel to said edge, a first arm support and a second arm support; said arm supports are attached to said uppermost surface forming said concave contour.

2. The adjustable body positioner as claimed in claim 1 wherein said first and second arm supports are constructed of a foam material and are triangular in cross section.

3. An adjustable body positioner comprising a foundation and an insert, said foundation being of a one piece construction and manufactured from a foam material and comprising an edge, a top piece and a bottom piece; said top and bottom pieces and said insert having substantially triangular cross sections and said insert being removeably interleaved between said top and said bottom piece, said top piece and said bottom piece are hinged along said edge of said foundation; said foundation further comprising an uppermost surface, a concave contour along the dimension parallel to said edge and a corrugated foam pad attached to said uppermost surface.

* * * * *